US010465327B2

(12) United States Patent
Lv et al.

(10) Patent No.: US 10,465,327 B2
(45) Date of Patent: Nov. 5, 2019

(54) WASHING MACHINE CONTROL PANEL BASE WITH FUNCTION OF AUTOMATICALLY ADDING DETERGENT

(71) Applicants: HAIER GROUP CORPORATION, Shandong (CN); QINGDAO HAIER WASHING MACHINE CO., LTD., Shandong (CN)

(72) Inventors: Peishi Lv, Shandong (CN); Lin Yang, Shandong (CN); Baozhen Cheng, Shandong (CN); Xiumei Wang, Shandong (CN); Zunan Liu, Shandong (CN)

(73) Assignee: Haier Group Corporation, Shandong (CN)

( * ) Notice: Subject to any disclaimer, the term of this patent is extended or adjusted under 35 U.S.C. 154(b) by 597 days.

(21) Appl. No.: 15/108,215

(22) PCT Filed: Jun. 12, 2014

(86) PCT No.: PCT/CN2014/079773
§ 371 (c)(1),
(2) Date: Jun. 24, 2016

(87) PCT Pub. No.: WO2015/096407
PCT Pub. Date: Jul. 2, 2015

(65) Prior Publication Data

US 2016/0326684 A1 Nov. 10, 2016

(30) Foreign Application Priority Data

Dec. 27, 2013 (CN) ..... 2013 1 0737908

(51) Int. Cl.
*D06F 39/02* (2006.01)

(52) U.S. Cl.
CPC ..... *D06F 39/028* (2013.01); *D06F 39/02* (2013.01); *D06F 39/022* (2013.01); *D06F 2216/00* (2013.01)

(58) Field of Classification Search
CPC ..... D06F 39/02; D06F 39/022; D06F 39/028; D06F 39/088; D06F 33/02
(Continued)

(56) References Cited

U.S. PATENT DOCUMENTS 6,401,499 B1 * 6/2002 Clark ..... D06F 39/022 68/17 R
6,434,977 B1 8/2002 Hapke et al.
(Continued)

FOREIGN PATENT DOCUMENTS

CN 101440564 A 5/2009
CN 201538905 U 8/2010
(Continued)

OTHER PUBLICATIONS

International Search Report dated Aug. 26, 2014 from International Patent Application No. PCT/CN2014/079773 filed Jun. 12, 2014.
(Continued)

*Primary Examiner* — David G Cormier
*Assistant Examiner* — Thomas Bucci
(74) *Attorney, Agent, or Firm* — David B. Tingey; Bryant J. Keller; Kirton McConkie

(57) ABSTRACT

A washing machine control panel base with function of automatically adding detergent is provided. At least one chamber configured to dispense solid detergents, at least one container configured to contain liquid detergents, and an automatic detergent dispensing apparatus which is in communication with both the chamber and the container are disposed in the control panel base; an upper end surface of the control panel base is provided with at least two detergent
(Continued)

dispensing ports; and each of the detergent dispensing ports is respectively in communication with the chamber and the container correspondingly. An accommodation space formed by an outer circumferential wall, an upper end surface connected to the outer circumferential wall, and an inner circumferential wall that forms a clothing feeding port is below the control panel base, and the chamber, the container, and the automatic detergent dispensing apparatus are all disposed in the accommodation space.

15 Claims, 8 Drawing Sheets

(58) Field of Classification Search
USPC ..... 68/17 R, 207, 12.18, 3 R, 13 R, 12.19, 68/200; 222/1, 129, 630, 133, 651, 132, 222/145.1, 173, 192, 52; 134/93, 99.2, 134/100.1, 95.1
See application file for complete search history.

(56) References Cited

U.S. PATENT DOCUMENTS 7,257,969 B2 * 8/2007 Kim ..... D06F 39/02 68/17 R
7,805,964 B2 * 10/2010 Park ..... D06F 39/02 68/12.18
8,056,374 B2 * 11/2011 Hoppe ..... D06F 39/125 134/99.2
8,196,441 B2 * 6/2012 Hendrickson ..... D06F 39/02 68/17 R
2004/0172770 A1 * 9/2004 Heo ..... D06F 39/02 8/158
2005/0284193 A1 * 12/2005 Lyu ..... D06F 39/02 68/17 R
2006/0081016 A1 * 4/2006 Hsu ..... D06F 39/022 68/12.18
2006/0107705 A1 * 5/2006 Hsu ..... D06F 33/02 68/17 R
2006/0272360 A1 * 12/2006 Hsu ..... A47L 15/4427 68/19
2007/0056328 A1 * 3/2007 Song ..... D06F 39/02 68/17 R
2007/0079637 A1 * 4/2007 Song ..... D06F 39/02 68/17 R
2007/0131000 A1 * 6/2007 Jeong ..... D06F 39/022 68/17 R
2008/0295546 A1 * 12/2008 Cho ..... D06F 39/02 68/17 R
2009/0053119 A1 * 2/2009 Richman ..... B01F 1/0027 422/300
2010/0000264 A1 * 1/2010 Luckman ..... D06F 33/02 68/4
2010/0018258 A1 * 1/2010 Cho ..... D06F 39/02 68/17 R
2010/0095712 A1 * 4/2010 Kim ..... D06F 39/02 68/12.18
2011/0056250 A1 * 3/2011 Kim ..... D06F 39/028 68/17 R
2012/0060569 A1 * 3/2012 Dunn ..... D06F 33/02 68/200
2012/0111067 A1 * 5/2012 Leibman ..... D06F 39/022 68/17 R
2012/0125055 A1 * 5/2012 Lee ..... D06F 39/02 68/17 R
2012/0151970 A1 * 6/2012 Leibman ..... D06F 39/00 68/17 R
2012/0240344 A1 * 9/2012 Lv ..... D06F 39/022 8/137
2012/0246836 A1 * 10/2012 Leibman ..... D06F 39/02 8/137
2013/0327101 A1 * 12/2013 Leibman ..... D06F 71/10 68/17 R

FOREIGN PATENT DOCUMENTS

CN 102535110 A 7/2012
CN 103334268 A 10/2013
CN 203334042 U 12/2013
CN 203741604 U 7/2014
CN 203741605 U 7/2014
CN 203741606 U 7/2014
EP 2133456 A1 12/2009
JP 2005137944 A 6/2005
JP 2013512053 A 4/2013

OTHER PUBLICATIONS

Search Report dated Nov. 14, 2017 from European Patent Application No. 14873906.3 filed Jun. 12, 2014.

* cited by examiner

WASHING MACHINE CONTROL PANEL BASE WITH FUNCTION OF AUTOMATICALLY ADDING DETERGENT

CROSS-REFERENCE

This application is a U.S. National Phase application of International Application No. PCT/CN2014/079773, filed Jun. 12, 2014, and claims benefit to Chinese Patent Application No. CN201310737908.6, filed Dec. 27, 2013, all of which is hereby incorporated by reference for all purposes.

TECHNICAL FIELD

The present disclosure relates to the field of washing machines, in particular to a fully automatic washing machine control panel base, and more in particular to a washing machine control panel base with function of automatically adding detergent.

BACKGROUND

A washing machine is a household appliance that uses mechanical energy to drive a water flow to wash fabrics such as clothing. According to rotation manners, washing machines are classified into fully automatic washing machines with rotary impellers and drum washing machines. The drum washing machine adopts a side-opening door, so that the door cannot be opened for adding during washing, and detergents such as liquid laundry detergents and softeners need to be added from outside and are washed into a drum by inlet water. For a typical fully automatic top-loading washing machine, a door cover is disposed at an upper position, and washing can be paused and the cover can be opened during washing, so that detergent dispensing requirements on previous products are not high.

A basic structure of a fully automatic washing machine is as follows. The fully automatic washing machine has a rectangular case; a rotatory washing inner tub for accommodating clothing is in the rectangular case; an impeller is disposed at bottom in the washing inner tub; the impeller may be driven by a power system to rotate; the power system includes a motor and a clutch system; top of the case is a door cover that can be opened, and a control panel occupies portions outside the door cover; a control system is disposed at back of the control panel; the control system nowadays is always a control circuit with a single-chip microcomputer as a core; the control system controls a rotation direction, rotation frequency, and a rotation speed of the motor and all electrical feedbacks of the washing machine such as an audible and visible alarm for prompting.

In an existing fully automatic washing machine, a detergent box is disposed inside a control panel base or at back of the control panel base. However, this traditional design causes a lot of defects and inconvenience: when the detergent box is disposed inside the control panel base, that is, drawably disposed in the control panel base at a rear side of a clothing feeding port, a side portion of the control panel base corresponding to the clothing feeding port is provided with an opening, and the detergent box is disposed in the opening, which affects not only aesthetics but also support strength of the control panel base. For each time of clothing washing, the detergent box needs to be pulled out first, and then detergents are added, so that a user feels troublesome to use the washing machine. It is more inconvenient to add detergents such as softeners when the washing machine is already working. When the detergent box is disposed at back of the control panel base, the detergent box is relatively far away from the user, the user needs to stretch an arm to add detergents, so that it is inconvenient for use, and external aesthetics is affected. In addition, detergents are dispensed manually, and a relative large or small dispensing amount would affect clothing washing effect.

However, with improvements of automation levels, requirements on intelligence of home appliances, environmental protection, and heath are increasingly higher, which imposes requirements on intelligent and automatic dispensing of the fully automatic washing machine.

In view of this, the present disclosure is provided.

SUMMARY

The technical problem to be solved by the present disclosure is to solve defects in the related art by providing a washing machine control panel base with function of automatically adding various liquid detergents such as liquid laundry detergents and softeners accurately.

To solve the foregoing technical problem, a basic idea of the technical scheme adopted by the present disclosure includes a washing machine control panel base with function of automatically adding detergent, where at least one chamber configured to dispense solid detergents, at least one container configured to contain liquid detergents, and an automatic detergent dispensing apparatus which is in communication with both the chamber and the container are disposed in the control panel base; an upper end surface of the control panel base is provided with at least two detergent dispensing ports; and each of the detergent dispensing ports is respectively in communication with the chamber and the container correspondingly.

Further, an accommodation space formed by an outer circumferential wall, an upper end surface connected to the outer circumferential wall, and an inner circumferential wall that forms a clothing feeding port is below the control panel base, and the chamber, the container, and the automatic detergent dispensing apparatus are all disposed in the accommodation space.

Further, the automatic detergent dispensing apparatus is an apparatus in which liquid detergents in the container are pumped using a negative pressure caused by flowing of inlet water through a Venturi tube for quantitative delivery.

Further, the automatic detergent dispensing apparatus includes a Venturi tube through which flowing of water can generate a negative pressure, and a measurement apparatus in communication with a negative pressure area of the Venturi tube; the measurement apparatus is in communication with the container; and a detergent dispensing control valve is disposed between the measurement apparatus and the container.

Further, the automatic detergent dispensing apparatus further includes a washing water path for the measurement apparatus, where water is input through the washing water path into the measurement apparatus, and is then pumped by the negative pressure to a path, at which the Venturi tube is located, for discharging.

Further, the chamber is of a structure of a box with an opening at an upper portion; where the opening is corresponding to a detergent dispensing port; a partition plate is disposed in the box, and divides internal of the box into an upper-layer space and a lower-layer space; the partition plate is provided with a water leaking port that is in communication with the upper-layer space and the lower-layer space; the upper-layer space is provided with a water input and uniformization structure; and the lower-layer space is provided with a water spraying port.

Further, the chamber includes a box body and an annular buckle cover; where the box body and the annular buckle cover engages on a periphery of the opening to form a water channel; the water channel is provided with a water inlet; an inner side wall of the water channel is further provided with a plurality of water uniformization through holes in communication with the upper-layer space; a water guiding plate is disposed in the water channel; and the water uniformization through holes and the water guiding plate form the water input and uniformization structure.

Further, the water channel is formed by at least two water slots connected and having different directions in sequence; a water guiding plate is disposed in each of the water slots in sequence starting from a water slot in which the water inlet is located to a water slot before the last water slot; the water guiding plate extends along a water flow direction in the water slot, and divides the water slot into inner and outer water paths by coordinating with inner and outer side walls of the water slot; the inner water path discharges water through a corresponding water uniformization through hole; an end of the inner water path extends from the water guiding plate to a starting end of a next water slot, and is closed at the starting end; and the outer water path guides water into the next water slot.

The water slot is formed by engaging, in a sealed manner, outwardly protruding bosses and an annular buckle cover that are at periphery of the opening of the box body.

Further, a side wall of the box body is formed by four side plates including a front side plate, a rear side plate, a left side plate, and a right side plate; where outer walls of the left side plate, the right side plate, and the front side plate are respectively provided with a left boss, a right boss, and a front boss that protrude outwardly; a height of each boss is lower than that of a top end of a corresponding side plate; top ends of the left side plate, the right side plate, and the front side plate are evenly provided with a plurality of notches forming the water uniformization through holes; the bosses are provided with the water guiding plates; the annular buckle cover is formed by an inner peripheral frame, an outer peripheral frame, and an annular top cover, and has a section of an h-shaped structure; the inner peripheral frame is located in the opening of the box body; there is a water leaking gap between a front frame of the inner peripheral frame and the front side plate, between a left frame of the inner peripheral frame and the left side plate, and between a right frame of the inner peripheral frame and the right side plate; a front frame, a left frame, and a right frame of the outer peripheral frame are lap-connected to the front boss, the left boss, and the right boss respectively in a sealed manner, to coordinate to form a water channel; and a rear frame of the outer peripheral frame is connected to the rear side plate in a sealed manner.

Further, there are at least two containers; and at least one container is formed by at least two sub-containers that are in communication with each other, and the container is in communication with a detergent dispensing port through one of the sub-containers.

Further, the detergent dispensing port is provided with a door cover that can be opened and closed.

Further, a rear portion of the upper end surface of the control panel base is provided with three detergent dispensing ports; a front portion of the upper end surface is provided with an operation display panel; a first detergent dispensing port is in communication with the chamber for dispensing solid detergents; a second detergent dispensing port and a third detergent dispensing port are in communication with corresponding containers respectively; and the second detergent dispensing port and the third detergent dispensing port are each provided with a door cover that can be opened and closed.

Further, the second detergent dispensing port and the third detergent dispensing port are disposed on two sides of the first detergent dispensing port respectively; there are two containers; the two containers are in communication with the second detergent dispensing port and the third detergent dispensing port respectively; and the containers and the chamber are distributed in the accommodation space.

Optionally, one of the containers is formed by two sub-containers that are in communication with each other.

The control panel base according to the present disclosure is provided with a water inlet valve. The water inlet valve is in communication with the automatic detergent dispensing apparatus. The automatic detergent dispensing apparatus is in communication with the chamber through a water outlet pipeline. The chamber is provided with a water spraying port. The container is in communication with the automatic detergent dispensing apparatus through a liquid pumping pipeline. A liquid detergent pumped by the automatic detergent dispensing apparatus flows to the chamber through the water outlet pipeline, and is discharged by the water spraying port.

The annular buckle cover is provided with two water inlets. The control panel base is further provided with a hot water valve. The hot water valve is in communication with a first water inlet. A second water inlet is in communication with the automatic detergent dispensing apparatus.

By adopting foregoing technical schemes, compared with the related art, the present disclosure has following beneficial effects.

According to the washing machine control panel base of the present disclosure, the chamber for dispensing solid detergents, the container for containing liquid detergents, and the automatic detergent dispensing apparatus are all mounted in the accommodation space formed below the control panel base, so that structures to be mounted in a scattered manner are mounted together on the control panel base, thereby facilitating modular production, simplifying production processes, and reducing production costs. Because the upper end surface of the control panel base is provided with the detergent dispensing ports for dispensing solid detergents and liquid detergents, a user can use the washing machine more conveniently. An internal space of the control panel base of the washing machine is fully taken advantage of, and the novel layout is user-friendly. The chamber for dispensing solid detergents is of an integrally formed structure, and is simple in structure and convenient for mounting. The upper-layer space of the chamber is provided with the water input and uniformization structure, water is guided by the water guiding plates into the water slots at different side portions, and the water flow is scattered by using the water uniformization through holes, so that the water input is even, and washing powder dissolves thoroughly, and is unlikely to agglomerate.

DETAILED DESCRIPTION OF THE EMBODIMENTS

Figure 1:
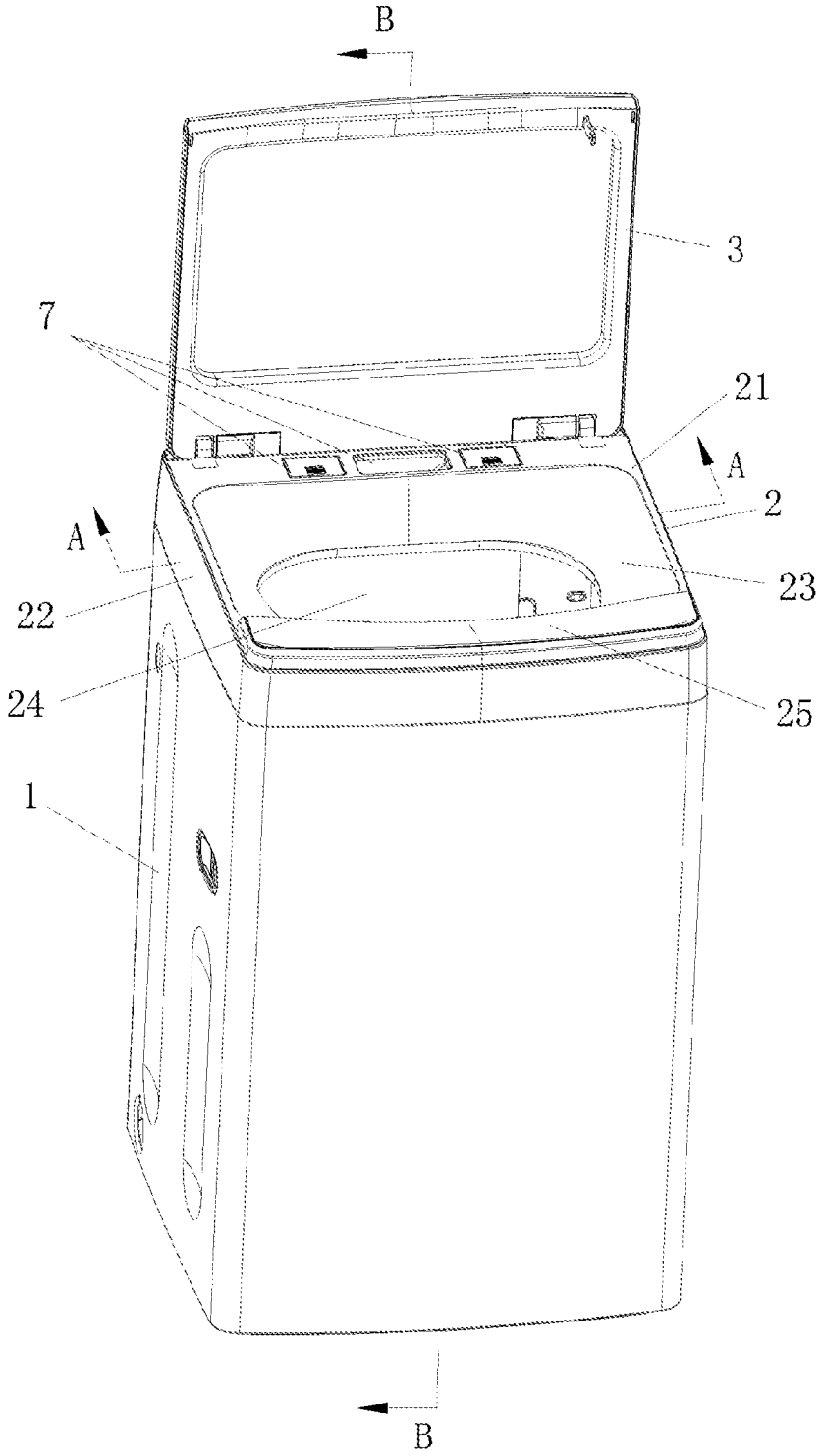
FIG. 1 is a schematic structural view showing a washing machine according to the present disclosure.
Figure 2:
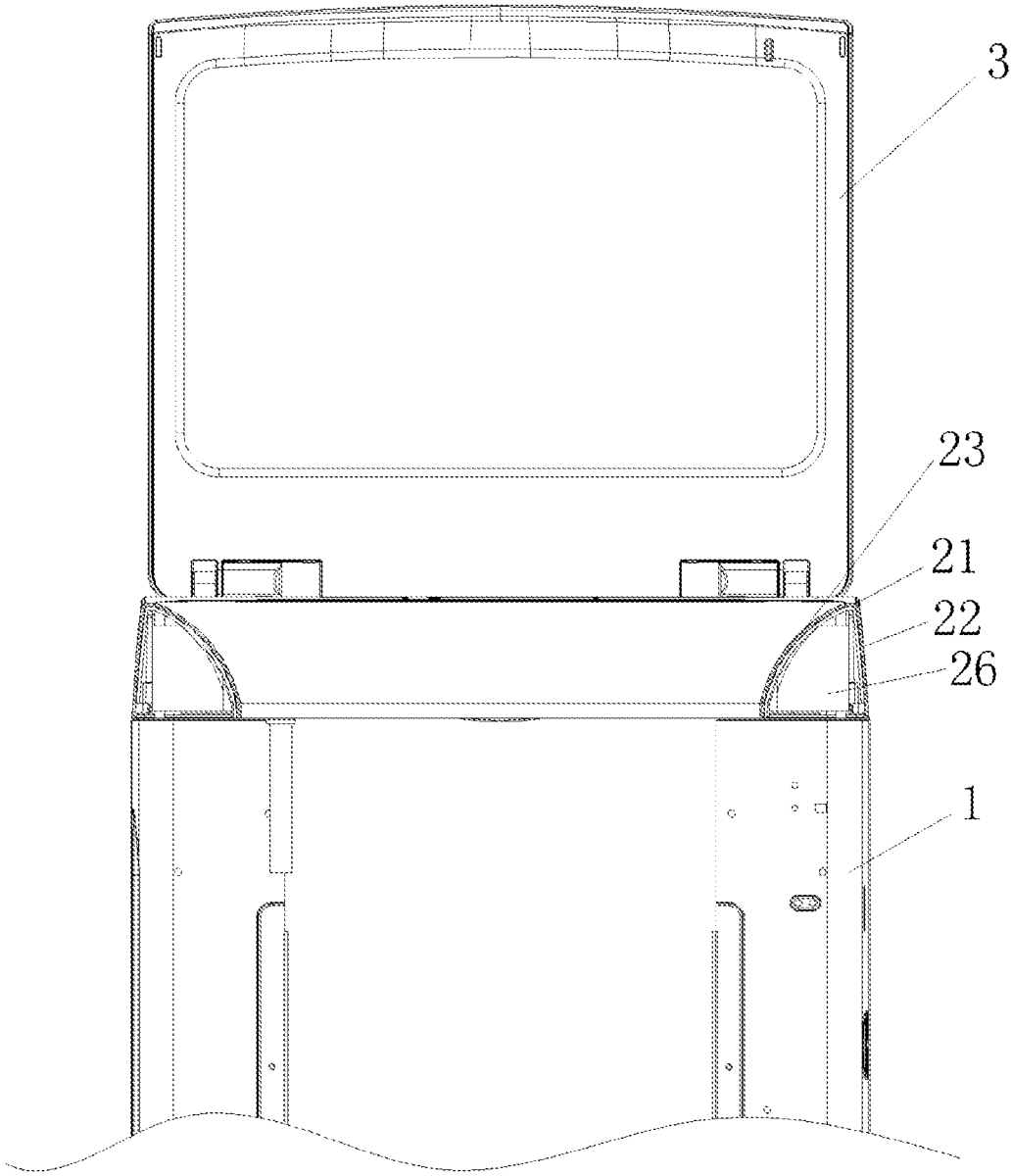
FIG. 2 is a partial view in a direction A-A in FIG. 1.

Specific embodiments of the present disclosure are further described below in detail in combination with accompanying drawings.

As shown in FIG. 1 to FIG. 5, a fully automatic washing machine includes a case 1, a control panel base 2 mounted at top of the case 1, and an upper cover 3 mounted on the control panel base 2. The upper cover 3 is hinge-connected to the control panel base 2 at a rear end. The control panel base 2 of the washing machine includes an upper end surface 21, an outer circumferential wall 22 and an inner circumferential wall 23 that are connected to the upper end surface 21 separately, and a clothing feeding port 24 formed by the inner circumferential wall. An operation display panel 25 is disposed at a front side of the control panel base 2, and is generally disposed at a front portion so as to be conveniently used by a user. An outer tub for containing water, and an inner tub disposed in the outer tub for containing clothing are mounted in the case. An upper portion of the inner tub is corresponding to the clothing feeding port. A driving apparatus and a drainage system (not shown in the figures) are disposed below the outer tub.

An accommodation space 26 integrally formed by the outer circumferential wall 22, the upper end surface 21 connected to the outer circumferential wall, and the inner circumferential wall 23 that forms the clothing feeding port 24 is below the control panel base 2 according to the present disclosure. At least one chamber 4 configured to dispense solid detergents, at least one container 5 configured to contain liquid detergents, and an automatic detergent dispensing apparatus 6 that is in communication with both the chamber 4 and the container 5 are disposed in the accommodation space 26. The upper end surface 21 of the control panel base is provided with at least two detergent dispensing ports 7, and each of the detergent dispensing ports 7 is respectively in communication with chamber 4 and the container 5 correspondingly.

Figure 3:
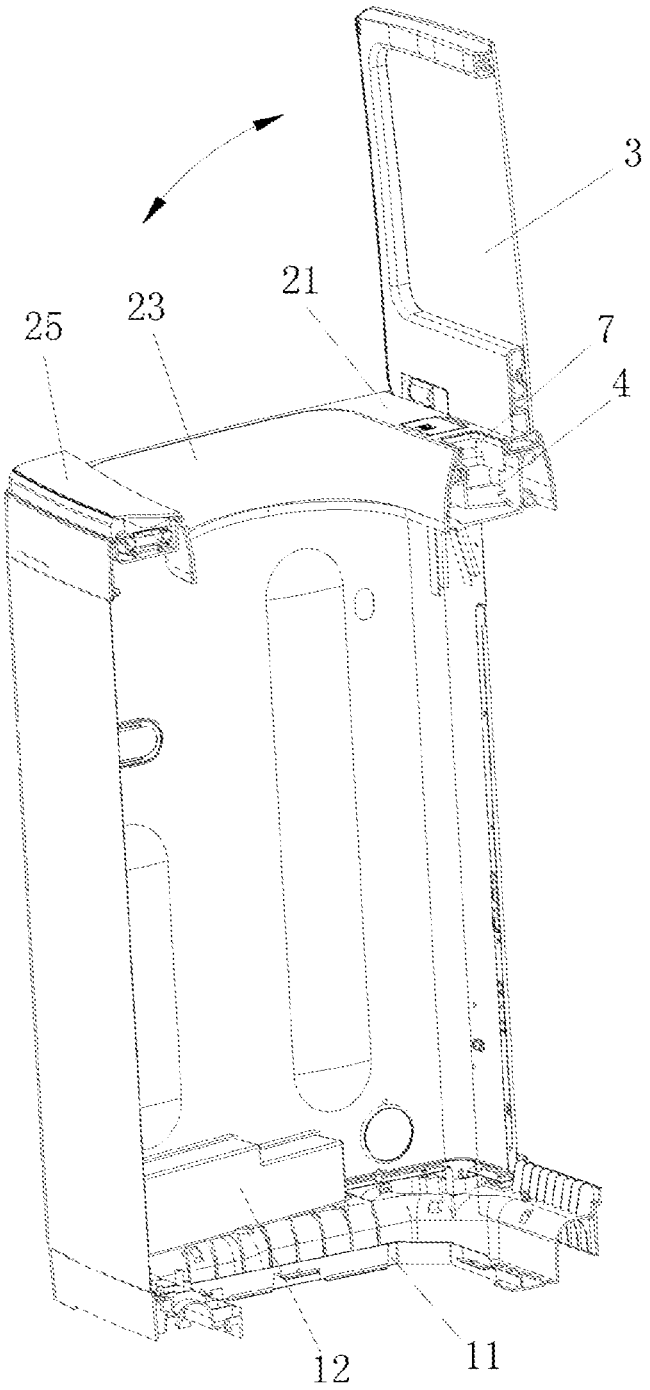
FIG. 3 is a view in a direction B-B in FIG. 1.

As shown in FIG. 3, the washing machine according to the present disclosure further includes a base 11 disposed at a lower portion of the case and a main control board 12 mounted on the base. The main control board 12 may also be disposed on a side wall of the case, or control modules for water feeding, water drainaging, motor driving and the like are dispersedly disposed in the case, and are connected to a main control module through data lines. Arrangements of foregoing structures relatively increase a volume of the accommodation space 26 at a lower portion of the control panel base, so as to contain a chamber and container, and the contained chamber and container are separately arranged from a control system, thereby improving safety performance of the washing machine.

The control panel base 2 is provided with a water inlet valve 27. The water inlet valve 27 is in communication with the automatic detergent dispensing apparatus 6. The automatic detergent dispensing apparatus 6 is in communication with the chamber 4 through a water outlet pipeline 8. The container 5 is in communication with the automatic detergent dispensing apparatus 6 through a liquid pumping pipeline 9. Liquid detergents pumped by the automatic detergent dispensing apparatus 6 flow to the chamber 4 through the water outlet pipeline 8, and then is discharged from the chamber 4.

Figure 5:
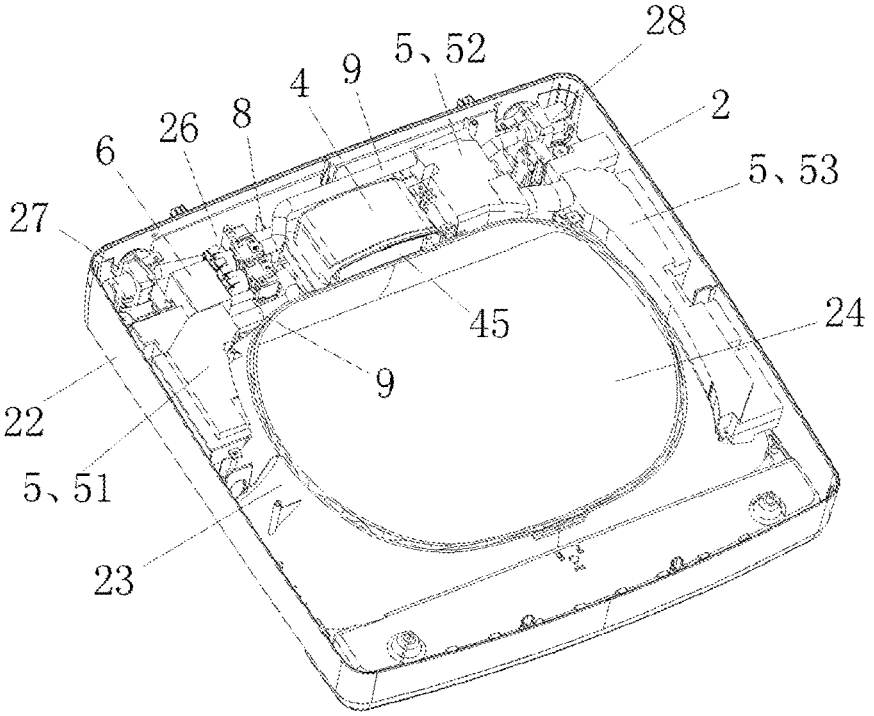
FIG. 5 is a schematic structural view showing a back of a control panel base according to the present disclosure.

Further, in order to increase a liquid storage capacity of the container, at least two containers 5 are disposed in the accommodation space 26, at least one container 5 is formed by at least two sub-containers that are in communication with each other (the at least two sub-containers comprise a second container 52 and a third container 53 as shown in FIG. 5), the two sub-containers contain same liquid detergents, and the container is in communication with a detergent dispensing port through one of the sub-containers.

The automatic detergent dispensing apparatus 6 according to the present disclosure is an apparatus in which liquid detergents in the container are pumped using a negative pressure caused by flowing of inlet water through a Venturi tube for quantitative delivery.

Embodiment 1

As shown in FIG. 6 to FIG. 9, the automatic detergent dispensing apparatus 6 according to the present disclosure includes a Venturi tube 61 through which flowing of water can generate a negative pressure, and a measurement apparatus 62 in communication with a negative pressure area of the Venturi tube. The measurement apparatus 62 is in communication with the container 5, and a detergent dispensing control valve 63 is disposed between the measurement apparatus 62 and the container 5. Corresponding to the negative pressure area of the Venturi tube, a liquid pumping port 64 in communication with the container 5 is disposed, and the measurement apparatus 62 for detecting a detergent dispensing amount is disposed between the liquid pumping port 64 and the container 5.

The automatic detergent dispensing apparatus 6 further includes a washing water path 65 for washing the measurement apparatus. A water inlet end of the washing water path 65 is in communication with a washing water outlet port 81 disposed on the water outlet pipeline 8. Inlet water from the water inlet valve 27 flows through the Venturi tube 61, then enters the measurement apparatus 62 through the washing water outlet port 81, and is discharged by a path connected from the measurement apparatus 62 to the negative pressure area of the Venturi tube. A washing control valve 66 is disposed on the washing water path 65.

When dispensing detergents, a path between the measurement apparatus 62 and the container 5 is opened, a path between the washing water path 65 and the measurement apparatus 62 is closed, and the water inlet valve 27 is opened. Water is input into the inner tub 10 through the water outlet pipeline 8. Detergents in the container 5 are pumped out by using a negative pressure caused by water flowing through the Venturi tube, and enter the water outlet pipeline 8 through the liquid pumping port 64 after measured by the measurement apparatus 62, and is washed into an inner tub 10 by an inlet water flow in the water outlet pipeline 8. When the measurement apparatus 62 detects that an amount of pumped detergents reach a corresponding required value or set value, the path between the measurement apparatus 62 and the container 5 is closed, a detergent dispensing is completed, and at the moment, a following step of measurement apparatus cleaning may be executed.

When cleaning the measurement apparatus, the water inlet valve 27 is opened, and water enters into the washing machine. At the moment, the path between the measurement apparatus 62 and the container 5 is closed, the path between the washing water path 65 and the measurement apparatus 62 is opened, and a water flow in the water outlet pipeline 8 passes through the Venturi tube 61. According to a Venturi effect principle, the water flow decreases from thick to fine, a flow rate of the inlet water increases, and the negative pressure area is caused. A washing water flow enters the water outlet pipeline 8 through the measurement apparatus 62 and the liquid pumping port 64, and is washed into the inner tub 10 by the inlet water flow in the water outlet pipeline 8. The foregoing process is also a separate water input step. During separate water input, the path between the washing water path 65 and the measurement apparatus 62 may also be closed in the foregoing step.

Embodiment 2

Figure 6:
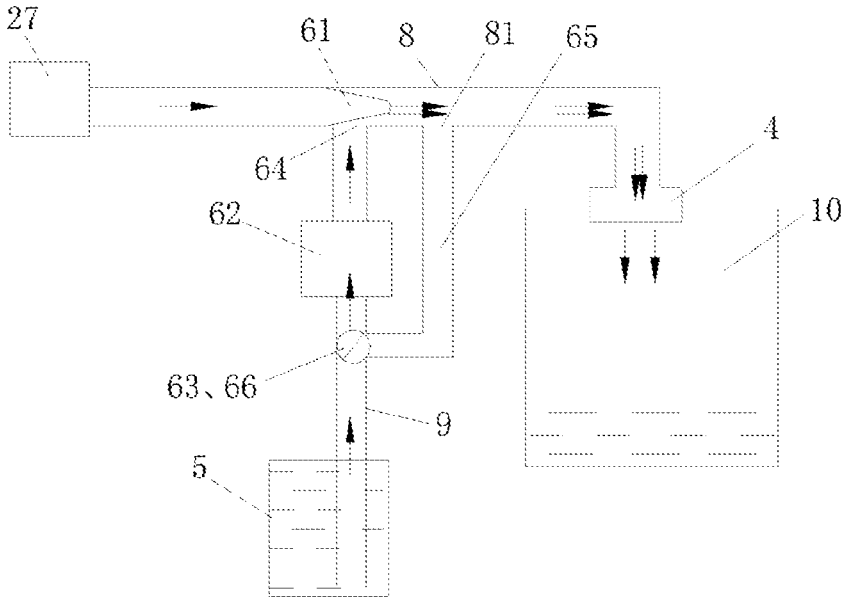
FIG. 6 to FIG. 9 are schematic views showing controlling of automatic detergent dispensing according to the present disclosure.

As shown in FIG. 6, there is one container 5 for containing liquid detergents in the automatic detergent dispensing apparatus 6 according to this embodiment. The washing control valve 66 on the washing water path 65 and the detergent dispensing control valve 63 are a same control valve which is a two-position three-way reversing valve provided with one outlet and two inlets. The outlet is in communication with the measurement apparatus 62, and the two inlets are respectively in communication with the container 5 and a water outlet end of the washing water path 65 correspondingly. The control valve controls opening/closing between the measurement apparatus 62 and the container 5, and also controls closing/opening between the measurement apparatus 62 and the washing water path 65.

Embodiment 3

Figure 7:
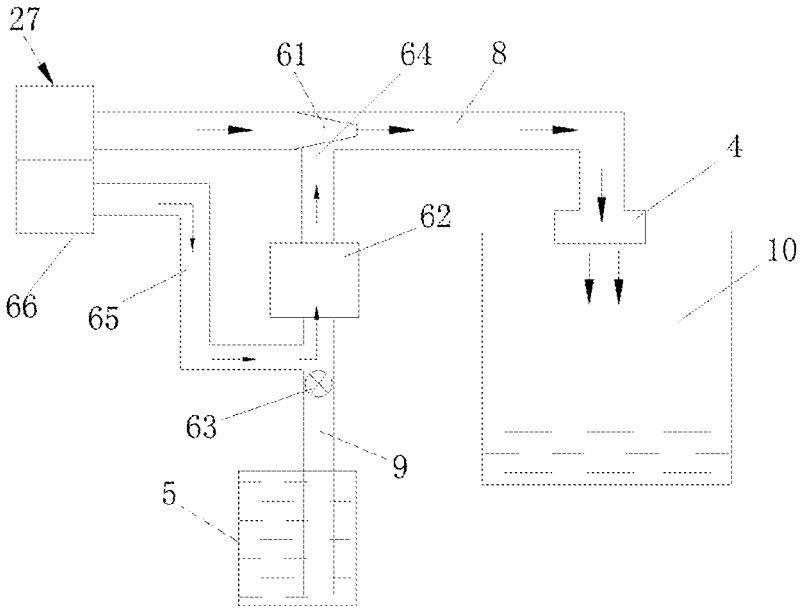

As shown in FIG. 7, the washing control valve 66 according to this embodiment is integrated on the water inlet valve 27, and the water inlet valve 27 is a solenoid valve provided with at least two water outlets. One of the water outlets is connected to the water outlet pipeline 8, and the other of the water outlets is connected to the washing water path 65.

Embodiment 4

Figure 8:
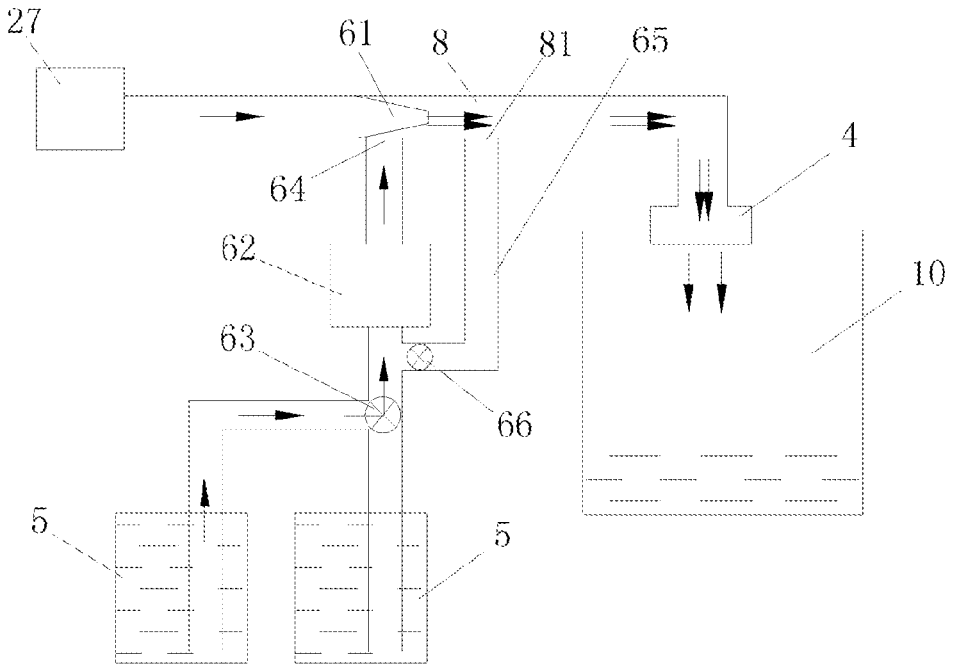
Figure 9:
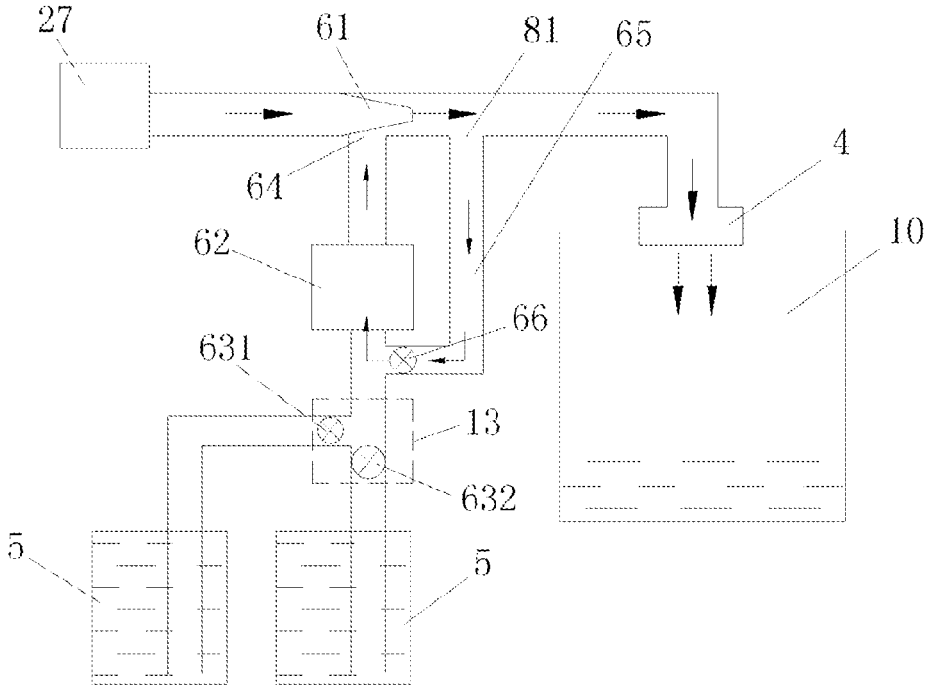
Figure 10:
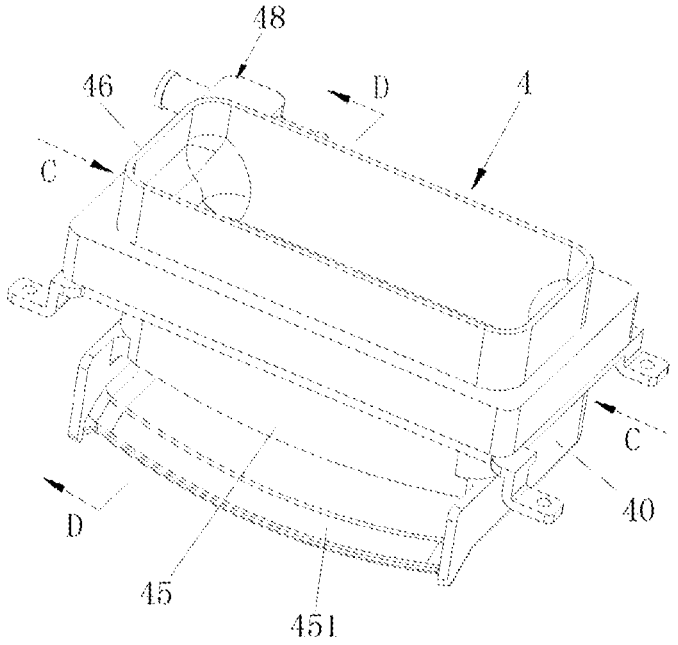
FIG. 10 is a schematic structural view showing a chamber according to the present disclosure.

As shown in FIG. 8 and FIG. 9, a difference between this embodiment and the foregoing embodiment lies in that: in this embodiment, there are two containers 5 for containing detergents, and the two containers 5 are a detergent container and a softener container. Opening and closing of both a path between the detergent container and the measurement apparatus 62 and a path between the softener container and the measurement apparatus 62 are controlled by the same detergent dispensing control valve 63. The detergent dispensing control valve 63 is a two-position three-way reversing valve provided with one outlet and two inlets. The outlet is in communication with the measurement apparatus 62, and the two inlets are respectively in communication with the detergent container and the softener container correspondingly (referring to FIG. 8).

Alternatively, the measurement apparatus 62 is in communication with the detergent container and the softener container through a tee pipe 13, and there are two detergent dispensing control valves 63, which are a detergent control valve 631 and a softener control valve 632 (referring to FIG. 9).

Embodiment 5

Figure 4:
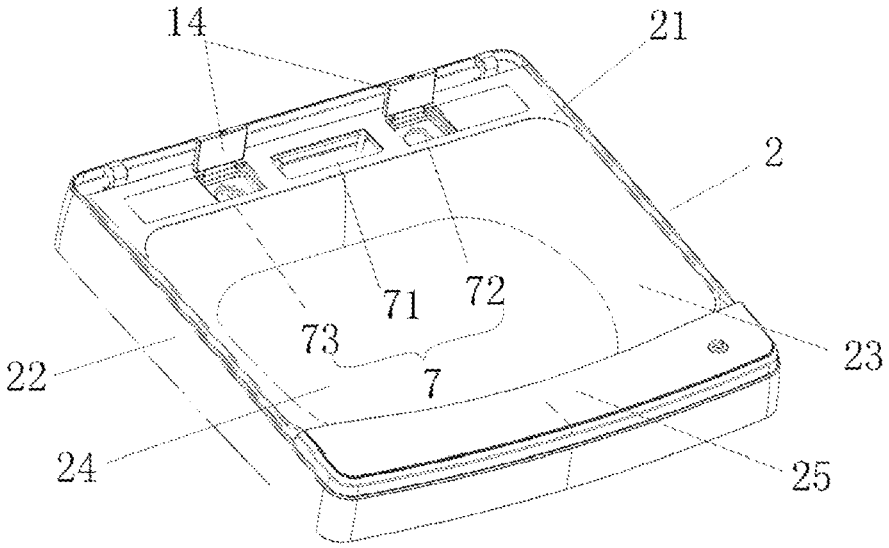
FIG. 4 is a schematic structural view showing a control panel base according to the present disclosure.

As shown in FIG. 4 and FIG. 5, a rear portion of the upper end surface 21 of the control panel base according to the present disclosure is provided with three detergent dispensing ports 7, and a front portion of the upper end surface 21 is provided with the operation display panel 25. In a closed state, the upper cover 3 of the washing machine covers the detergent dispensing ports 7, and exposes the operation display panel 25 at the front portion. Among the three detergent dispensing ports 7, a first detergent dispensing port 71 is in communication with the chamber 4 for dispensing solid detergents, and the chamber 4 is below the first detergent dispensing port 71 and is generally configured to dispense washing powder; and a second detergent dispensing port 72 and a third detergent dispensing port 73 are in communication with different containers respectively, and the second detergent dispensing port 72 and the third detergent dispensing port 73 are each provided with a door cover 14 that can be opened and closed.

According to a scheme of this embodiment, the second detergent dispensing port 72 and the third detergent dispensing port 73 are disposed on two sides of the first detergent dispensing port 71 respectively; the containers 5 include a first container 51, a second container 52, and a third container 53; the third container 53 is in communication with the second container 52; the first container 51 is in communication with the second detergent dispensing port 72; the second container 52 is in communication with the third detergent dispensing port 73; the first container 51, the second container 52, the third container 53, and the chamber 4 are distributed on left side and right side of the clothing feeding port 24, and in the accommodation space 26 at a rear side of the clothing feeding port 24. The first container 51 is a container for containing softeners, and the second container 52 and the third container 53 are containers for containing liquid detergents.

Embodiment 6

As shown in FIG. 10 to FIG. 13, the chamber 4 according to the present disclosure is of a structure of a box with an opening at an upper portion. The opening is corresponding to a detergent dispensing port 7 (referring to FIG. 3). A partition plate 41 is disposed in the box, and divides internal of the box into an upper-layer space 42 and a lower-layer space 43. The partition plate 41 is provided with a water leaking port 44 that is in communication with the upper-layer space 42 and the lower-layer space 43. The upper-layer space 42 is provided with a water input and uniformization structure. The lower-layer space 43 is provided with a water spraying port 45. Bottom of the water spraying port 45 is provided with a flow guiding plate 451 extending forwardly. The flow guiding plate 451 tilts downwardly, so as to facilitate spraying of water into the inner tub.

The chamber 4 includes a box body 40 and an annular buckle cover 46. The box body 40 and the annular buckle cover 46 engages on a periphery of the opening to form a water channel 47. The water channel 47 is provided with a water inlet 48. An inner side wall of the water channel 47 is further provided with a plurality of water uniformization through holes 471 in communication with the upper-layer space. A water guiding plate 472 is disposed in the water channel 47. The water uniformization through holes 471 and the water guiding plate 472 form the water input and uniformization structure.

Figure 12:
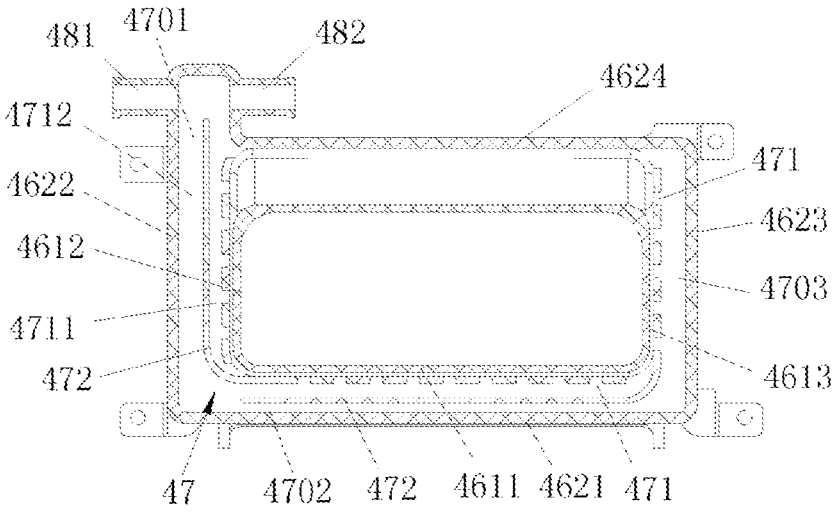
FIG. 12 is a view in a direction C-C in FIG. 10.

As shown in FIG. 12, the water channel 47 is formed by three water slots 4701, 4702, and 4703 connected and having different directions in sequence. A water guiding plate 472 is disposed in each of the water slots in sequence starting from the water slot 4701 in which the water inlet 48 is located to a water slot before the last water slot 4703. The water guiding plate 472 extends along a water flow direction in the water slot, and divides the water slot into an inner water path 4711 and an outer water path 4712 by coordinating with inner and outer side walls of the water slot. The inner water path 4711 discharges water through a corresponding water uniformization through hole 471, an end of the inner water path extends from the water guiding plate 472 to a starting end of the next water slot 4702 or 4703, and is closed at the starting end. The outer water path 4712 guides water into the next water slot 4702 or 4703, and discharges water through the water uniformization through hole 471 corresponding to the last water slot 4703.

Figure 11:
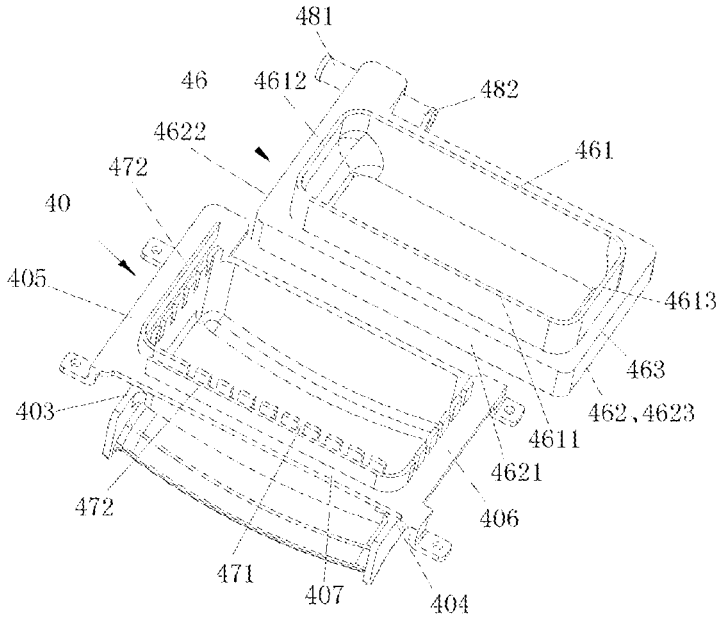
FIG. 11 is a schematic structural view showing assembling of a chamber according to the present disclosure.
Figure 13:
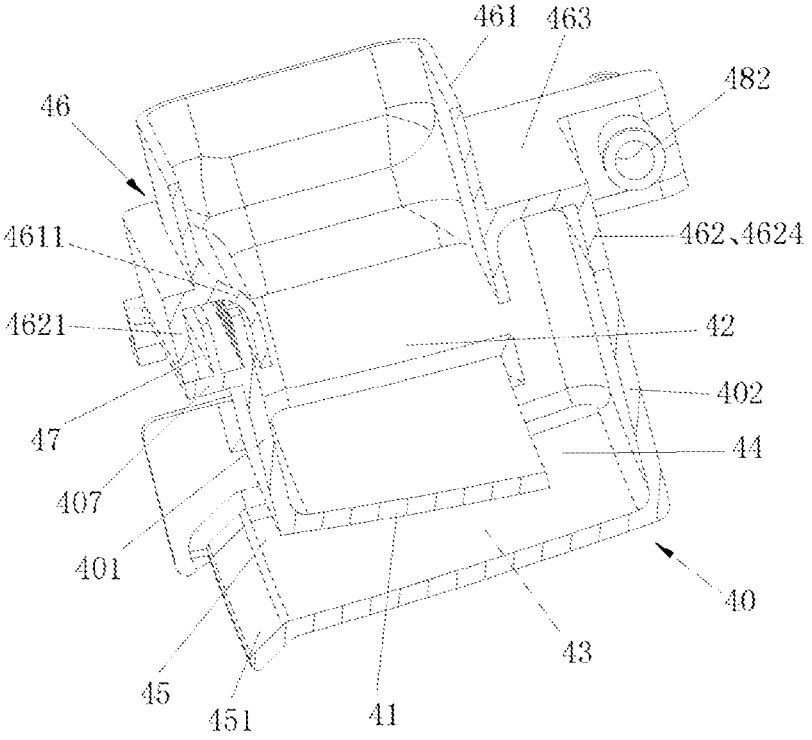
FIG. 13 is a view in a direction D-D in FIG. 10.

As shown in FIG. 11 to FIG. 13, a side wall of the box body 40 is formed by four side plates including a front side plate 401, a rear side plate 402, a left side plate 403, and a right side plate 404. Outer walls of the left side plate 403, the right side plate 404, and the front side plate 401 are respectively provided with a left boss 405, a right boss 406, and a front boss 407 that protrude outwardly. A height of each boss is lower than that of a top end of a corresponding side plate. Top ends of the left side plate 403, the right side plate 404, and the front side plate 401 are evenly provided with a plurality of notches forming the water uniformization through holes 471. The left boss 405 and the front boss 407 are provided with the water guiding plates 472. The annular buckle cover 46 is formed by an inner peripheral frame 461, an outer peripheral frame 462, and an annular top cover 463, and has a section of an h-shaped structure. The inner peripheral frame 461 is located in the opening of the box body 40. There is a water leaking gap between a front frame 4611 of the inner peripheral frame 461 and the front side plate 401, between a left frame 4612 of the inner peripheral frame 461 and the left side plate 403, and between a right frame 4613 of the inner peripheral frame 461 and the right side plate 404. A front frame 4621, a left frame 4622, and a right frame 4623 of the outer peripheral frame 462 are lap-connected to the front boss 407, the left boss 405, and the right boss 406 respectively in a sealed manner, to coordinate to form an integral water channel 47, which is formed by a left water slot, a front water slot, and a right water slot that are connected in sequence. A rear frame 4624 of the outer peripheral frame 462 is connected to the rear side plate 402 in a sealed manner. The front side plate 401 corresponding to the lower-layer space 43 is provided with the water spraying port 45.

Embodiment 7

As shown in FIG. 5, the control panel base 2 according to the present disclosure is further provided with a hot water valve 28. The hot water valve 28 is in direct communication with the chamber 4 through a hot water pipeline. The annular buckle cover 46 is provided with two water inlets 481 and 482. The hot water valve 28 is in communication with the first water inlet 481, and the second water inlet 482 is in communication with the automatic detergent dispensing apparatus 6 through the water outlet pipeline 8. If hot water is needed for washing, water may be input by using the two water inlets at the same time; and if hot water is not needed for washing, the hot water valve 28 is turned off, and water is input directly through the water inlet valve 27, the water enters the chamber 4 through the Venturi tube 61, the water outlet pipeline 8, and the second water inlet 482 successively, and is discharged by the water spraying port 45 into the inner tub.

The implementation schemes in the foregoing embodiments may further undergo combination or replacement. Moreover, the embodiments only describe embodiments of the present disclosure, but are not intended to limit the idea and scope of the present disclosure. Modifications and improvements made to the technical scheme of the present disclosure by those skilled in the art without departing from the design idea of the present disclosure all fall within the protection scope of the present disclosure.

What is claimed is:

1. A washing machine control panel base with function of automatically adding detergent, comprising: at least one chamber configured to dispense solid detergents, at least one container configured to contain liquid detergents, and an automatic detergent dispensing apparatus which is in communication with both the at least one chamber and the at least one container; wherein an upper end surface of the control panel base is provided with at least two detergent dispensing ports; and each of the detergent dispensing ports is respectively in communication with the at least one chamber and the at least one container correspondingly, wherein: the automatic detergent dispensing apparatus is an apparatus in which liquid detergents in the at least one container are pumped using a negative pressure caused by flowing of inlet water through a Venturi tube for quantitative delivery, wherein: the automatic detergent dispensing apparatus comprises the Venturi tube through which flowing of water can generate a negative pressure, and a measurement apparatus in communication with a negative pressure area of the Venturi tube; wherein the measurement apparatus is in communication with the at least one container; and a detergent dispensing control valve is disposed between the measurement apparatus and the at least one container, the measurement apparatus being configured to detect a detergent dispensing amount; wherein the control panel base comprises an outer circumferential wall and an inner circumferential wall separately connected to the upper end surface, wherein an accommodation space is formed by the outer circumferential wall, the upper end surface connected to the outer circumferential wall, and the inner circumferential wall that forms a clothing feeding port, wherein the at least one chamber, the at least one container, and the automatic detergent dispensing apparatus are all disposed in the accommodation space.

2. The washing machine control panel base with function of automatically adding detergent according to claim 1, wherein: the automatic detergent dispensing apparatus further comprises a washing water path for the measurement apparatus; wherein water is input through the washing water path into the measurement apparatus, and is then pumped by the negative pressure to a path, at which the Venturi tube is located, for discharging.

3. The washing machine control panel base with function of automatically adding detergent according to claim 1, wherein: the at least one chamber is of a structure of a box with an opening at an upper portion; wherein the opening is corresponding to a detergent dispensing port; a partition plate is disposed in the box, and divides internal of the box into an upper-layer space and a lower-layer space; the partition plate is provided with a water leaking port that is in communication with the upper-layer space and the lower-layer space; the upper-layer space is provided with a water input and uniformization structure; and the lower-layer space is provided with a water spraying port.

4. The washing machine control panel base with function of automatically adding detergent according to claim 3, wherein: the at least one chamber comprises a box body and an annular buckle cover; wherein the box body and the annular buckle cover engages on a periphery of the opening to form a water channel; the water channel is provided with a water inlet; an inner side wall of the water channel is further provided with a plurality of water uniformization through holes in communication with the upper-layer space; water guiding plates are disposed in the water channel; and the water uniformization through holes and the water guiding plates form the water input and uniformization structure.

5. The washing machine control panel base with function of automatically adding detergent according to claim 4, wherein: the water channel is formed by at least three water slots connected in sequence and having different extension directions; each of the water guiding plates is disposed in a respective one of the at least three water slots connected in sequence from a water slot in which the water inlet is located to a water slot adjacent to a last water slot; each of the water guiding plates extends along a water flow direction in the respective one of the at least three water slots, and divides the respective one of the at least three water slots into inner and outer water paths by coordinating with inner and outer side walls of the respective one of the at least three water slots; the inner water path discharges water through a corresponding water uniformization through hole; an end of the inner water path extends from each of the water guiding plates to a starting end of a next water slot, and is closed at the starting end; and the outer water path guides water into the next water slot.

6. The washing machine control panel base with function of automatically adding detergent according to claim 5, wherein: the at least two water slots are formed by engaging, in a sealed manner, outwardly protruding bosses and an annular buckle cover that are at periphery of the opening of the box body.

7. The washing machine control panel base with function of automatically adding detergent according to claim 5, wherein: a side wall of the box body is formed by four side plates comprising a front side plate, a rear side plate, a left side plate, and a right side plate; wherein outer walls of the left side plate, the right side plate, and the front side plate are respectively provided with a left boss, a right boss, and a front boss that protrude outwardly; a height of each boss is lower than that of a top end of a corresponding side plate; top ends of the left side plate, the right side plate, and the front side plate are evenly provided with a plurality of notches forming the water uniformization through holes; the bosses are provided with the water guiding plates; the annular buckle cover is formed by an inner peripheral frame, an outer peripheral frame, and an annular top cover, and has a section of an h-shaped structure; the inner peripheral frame is located in the opening of the box body; there is a water leaking gap between a front frame of the inner peripheral frame and the front side plate, between a left frame of the inner peripheral frame and the left side plate, and between a right frame of the inner peripheral frame and the right side plate; a front frame, a left frame, and a right frame of the outer peripheral frame are lap-connected to the front boss, the left boss, and the right boss respectively in a sealed manner, to coordinate to form the water channel; and a rear frame of the outer peripheral frame is connected to the rear side plate in a sealed manner.

8. The washing machine control panel base with function of automatically adding detergent according to claim 1, wherein: there are at least two containers; and at least one container is formed by at least two sub-containers that are in communication with each other, and the at least one container is in communication with a detergent dispensing port through one of the at least two sub-containers.

9. The washing machine control panel base with function of automatically adding detergent according to claim 1, wherein: the at least two detergent dispensing ports are each provided with a door cover that can be opened and closed.

10. The washing machine control panel base with function of automatically adding detergent according to claim 1, wherein: a rear portion of the upper end surface of the control panel base is provided with three detergent dispensing ports; a front portion of the upper end surface is provided with an operation display panel; a first detergent dispensing port is in communication with the at least one chamber for dispensing solid detergents; a second detergent dispensing port and a third detergent dispensing port are in communication with corresponding containers respectively; and the second detergent dispensing port and the third detergent dispensing port are each provided with a door cover that can be opened and closed.

11. The washing machine control panel base with function of automatically adding detergent according to claim 10, wherein: the second detergent dispensing port and the third detergent dispensing port are disposed on two sides of the first detergent dispensing port respectively; there are two containers; the two containers are in communication with the second detergent dispensing port and the third detergent dispensing port respectively; and the containers and the at least one chamber are distributed in the accommodation space.

12. The washing machine control panel base with function of automatically adding detergent according to claim 11, wherein: one of the two containers is formed by two sub-containers that are in communication with each other.

13. The washing machine control panel base with function of automatically adding detergent according to claim 1, wherein: a rear portion of the upper end surface of the control panel base is provided with three detergent dispensing ports; a front portion of the upper end surface is provided with an operation display panel; a first detergent dispensing port is in communication with the at least one chamber for dispensing solid detergents; a second detergent dispensing port and a third detergent dispensing port are in communication with corresponding containers respectively; and the second detergent dispensing port and the third detergent dispensing port are each provided with a door cover that can be opened and closed.

14. The washing machine control panel base with function of automatically adding detergent according to claim 13, wherein: the second detergent dispensing port and the third detergent dispensing port are disposed on two sides of the first detergent dispensing port respectively; there are two containers; the two containers are in communication with the second detergent dispensing port and the third detergent dispensing port respectively; and the containers and the at least one chamber are distributed in the accommodation space.

15. The washing machine control panel base with function of automatically adding detergent according to claim 14, wherein: one of the two containers is formed by two sub-containers that are in communication with each other.

* * * * *